US005582629A

United States Patent [19]

Nakai et al.

[11] Patent Number: 5,582,629

[45] Date of Patent: Dec. 10, 1996

[54] TREATMENT PROCESS OF SPONGE TITANIUM POWDER

[75] Inventors: Sadao Nakai; Kazuaki Arakawa, both of Osaka, Japan

[73] Assignee: Kurimoto, Ltd., Osaka, Japan

[21] Appl. No.: 392,090

[22] Filed: Feb. 22, 1995

[30] Foreign Application Priority Data

Oct. 7, 1994 [JP] Japan ..... 6-270628

[51] Int. Cl.[6] ..... B22F 9/04

[52] U.S. Cl. ..... 75/352; 75/354; 241/27

[58] Field of Search ..... 75/352, 354; 148/513; 241/18, 27, 30

[56] References Cited

U.S. PATENT DOCUMENTS

| | | | |
|---|---|---|---|
| 3,930,841 | 1/1976 | Volin et al. | 148/513 |
| 4,761,263 | 8/1988 | Politis et al. | 241/27 |
| 4,934,610 | 6/1990 | Buans | 241/18 |

*Primary Examiner*—George Wyszomierski
*Attorney, Agent, or Firm*—Jones, Tullar & Cooper, P.C.

[57] ABSTRACT

The present invention provides a process for reforming sponge titanium powder into intermediate titanium particles of desirable fluidity and superior bulk specific gravity suitable as a starting material of a titanium or titanium alloy product to be produced by powder metallurgy, comprising the steps of: charging a sponge titanium powder in mill pots of a planetary ball mill together with crushing medium; collapsing the particles of the powder to be consolidated forming a squamation under an inert atmosphere in the mill pots; and adjusting the particle size and particle diameter by cutting the squamated particle under an inert atmosphere in a crushing medium stirring mill. Thus a fundamental process has been developed for producing a material for a compact completely provided with superior properties of titanium such as high specific intensity, high fatique resistance at a considerably low cost just by molding powder and sintering it using an inexpensive powder of low purity without any hydrogeneration-dehydrogeneration treatment, HIP treatment, heat treatment and surface treatment, etc.

1 Claim, 6 Drawing Sheets

TREATMENT PROCESS OF SPONGE TITANIUM POWDER

BACKGROUND OF THE INVENTION

1. Field of the Invention

The present invention relates to a process for treating a sponge titanium powder to be used in a power metallurgy process as a starting material of a compact having titanium or titanium alloy.

2. Prior Art

Titanium or titanium alloy is an ideal metallic material to be used as a structural material because of its high toughness and superior specific intensity among metals practically used, in spite of a smaller specific gravity than steel. Furthermore, titanium or titanium alloy is also superior in corrosion resistance particularly to seawater and, therefore, this material has been widely employed not only for military weapons, aircraft and space rockets but also for private uses such as spectacle frames, golf goods, fishing rods, etc. In view of the superior characteristics such as light weight, toughness, corrosion resistance, titanium or titanium alloy is a material which is further expected in the future to play a more important role in modern industry.

However, to obtain a molded titanium product, it is necessary at present to install large-scale accurate equipment or plant and to carry out troublesome and skillful processes. The production of titanium and titanium alloy products can be broadly classified into two processes, i.e., a refining process which yields a sponge titanium and a later working process. In the former process, after producing a titanium tetrachloride by reaction between titanium ore (rutile) and chlorine gas and refining it, the titanium tetrachloride is reduced using metallic magnesium or sodium to obtain a sponge titanium. This metallic titanium is generally a sponge-like porous mass and, therefore, it is referred to as sponge titanium. The reduction method using metallic magnesium is called the Kroll process which is now most popularly employed. The obtained massive sponge titanium is then subjected to a crusher to be supplied in the form of grains to the next step, and in this crushing step, a fine powder thereof is selected as a by-product called sponge fine to be separately utilized.

The process up to the production of the sponge titanium requires a large amount of electric power even exceeding that for refinining aluminum. This required electric power occupies a significant percentage of the production cost of the sponge titanium, but it still remains in almost the same level as the material cost of ordinary stainless steel, heat resistant steel or the like. Therefore, a principal reason for the sharp increase in the production cost of titanium products depends largely upon the working process carried out later.

The reason for the sharp rise in price of finished titanium products amountings to 10 times as much as sponge titanium consists in the fact that titanium is by nature a material which is physically and chemically very active and, therefore, reaction thereof when contacting other components is very active throughout all the steps for forming a final product including dissolution, casting, forging, rolling and heat treatment, and that certain equipment for preventing pollution due to such active reaction and complicated procedures are essentially required, eventually resulting in abnormally high cost. To meet this problem of high cost, a molding by powder metallurgy not requiring any dissolution comes to attract one's attention, and in which so-called near-net-shape molding is possible to obtain a shape similar to that of the final product. This molding method has advantages such as improvement in material yield, large reduction in cutting and grinding cost, and therefore various developments have been designated to the application of this method for the purpose of largely reducing the production cost of titanium products to be put in practical use from an economical point of view.

The molding by powder metallurgy is classified into the blended element method and the pre-alloyed method. In either method, the starting material is a fine powder of titanium or titanium alloy and, therefore, the step for processing from a sponge titanium to a fine powder is indispensable. It is certain that the mentioned by-product obtained at the time of crushing a sponge is also a fine powder, but if using this by-product as it is as a starting material of the powder metallurgy method, there arises a disadvantage in a deterioration of material properties of the product, particularly a remarkable deterioration in the fatigue resistance characteristic. It has been acknowledged that such a decline in fatigue strength is caused by residual holes formed due to a chloride compound included in the powder material.

Metallic titanium has a characteristic of embrittlement when adsorbing or storing hydrogen. Thus, a hydrogeneration-dehydrogeneration method (HDH method) is also a popular method in which, utilizing the mentioned characteristic, a titanium hydride embrittled by hydrogeneration is crushed into a powder, which is then dehydrogenerated. This HDH method is widely adopted in this field of industry as one of the processes for efficiently obtaining a desired particle size of titanium or titanium alloy powder.

In a recent molding technique of titanium products by power metallurgy, a sponge titanium is transformed into a powder by the HDH method, and after sintering the power, a hot isostatic pressing (HIP) process is introduced for the purpose of collapsing the voids. Thus, it may be said that a titanium product obtained by the blended element method has reached the same level as a product obtained by melting and forging.

The process of the HDH method comprises the steps of hydrogenerating a sponge titanium; crushing; dehydrogenerating by heating and vacuum suction; sintering by heating; and cracking. To carry out this process a, large-scale equipmemt, long time, and much labor are required as a matter of course. Further, in the later process for obtaining a near-net-shape using the powder obtained in the former process as a starting material, the mentioned HIP process must be performed for applying a very strong pressure so as to collapse residual voids remaining in the mentioned powder. It is not an ignorable burden that such an intermediate process also requires large-scale equipment, a long time, and much labor. After all, it seems quite difficult to accomplish the object of sharply reducing the cost of titanium products and, therefore, it may be said that a primary factor of high cost restricting the usefulness of titanium still remains unsolved.

In view of the foregoing situation, an idea has been conceived in that a mechanical treatment is applied to obtain a powder suitable for the process of titanium by powder metallurgy. For example, the Japanese Laid-Open Patent Publication No. Hei 5-163508 discloses that, in the process for producing a titanium powder by the HDH method, an apparatus provided with some crushing means such as hammer crusher, hammer breaker, hammer mill is disposed, in substitution for a cutter mill conventionally disposed for cracking a sintered titanium mass after dehydrogeneration, to cut off sharp corner portions of every fine particle thereby obtaining a powder of desirable fluidity and high density suitable as a starting material for powder metallurgy. However, as far as this process employs the HDH method, it is doubtful that this process can bring about a remarkable cost reduction, i.e., it may be said that this prior method is yet insufficient for solving the mentioned problem of high production cost for titanium products.

SUMMARY OF THE INVENTION

The present invention was made to solve the above-discussed problems and has an object of providing a treatment process in which a very strong mechanical treatment is applied to all powder obtained from sponge titanium including sponge fine irrespective of any intermediate process, so as to be transformed into a powder mass suitable as a starting material for subsequent processes.

A treatment process of sponge titanium powder according to the present invention comprises the steps of: charging a sponge titanium powder in mill pots of a planetary ball mill together with crushing mediums: collapsing particles of the powder to be consolidated forming a squamation under an inert atmosphere in the mill pots: and adjusting particle size and particle diameter by cutting the squamated powder particle under an inert atmosphere in a crushing media agitating mill, thereby reforming the sponge titanium powder into intermediate titanium fine particles suitable as a starting material of titanium or titanium alloy product to be produced by powder metallurgy.

It is preferable that the planetary ball mill employed in the mentioned treatment process is a batch type planetary ball mill in which a composite crushing acceleration ratio G applied to an internal part of the mill pot, and expressed below, is at least not less than 30, and the angular velocity ratio R of rotation and revolution is not more than 1.9:

$$G=a\ max/g=(\omega_1 l)^2/2\ g\ (k+N\times(1+R)^2)$$

where G: is the composite centrifugal acceleration ratio, a max: is the composite centrifugal acceleration ($m/s^2$), g: is the gravitational acceleration ($m/s^2$), $\omega_1$: is the revolutionary angular velocity (1/s), K: is the revolutionary diameter (m), N: is the mill pot internal diameter (m), $\omega_2$: is the rotational angular velocity relative to revolution, and $$R:\omega_{2/\omega l}.$$

It is most preferable that the inert atmosphere is established either by filling the mill pot with Ar gas or He gas or by using an atmosphere controlling means for causing a gas to flow through inside.

Conventional sponge titanium powder such as sponge fine obtained by mechanically crushing a sponge titanium has disadvantages in that the shape of the particles is complicated and possess voids inside resulting in poor charging characteristic and, moreover, bulky inclusion (chloride) may be mixed into the obtained sponge titanium powder, thus deteriorating the molded powder product in its fatigue strength aspect.

On the other hand, the titanium powder according to the present invention is subject to a strong mechanical treatment peculiar to the planetary ball mill. Generally in the planetary ball mill of ordinary construction, a plurality of mill pots revolving according to the rotation of a main shaft are disposed round the main shaft evenly (i.e., symmetrically in case of two mill pots, or radially from the main shaft with equal distance in case of three mill pots), and these mill pots themselves rotate round their own axis. Accordingly, when charging the crushing mediums and sponge titanium powder into the mill pots and driving a motor, the mill pots are caused to rotate and revolve, and the crushing mediums start their proper motion by centrifugal acceleration to collapse the sponge titanium powder to to be flattened forming a squamation, whereby the voids remaining in the powder particles are broken and, at the same time, the mentioned bulky inclusions (chloride) are crushed into fine particles to be dispersed.

More specifically, in the conventional crusher such as a tumbling mill, the ball-shaped crushing mediums and the charged material perform a cascade motion in a rolling cylinder, whereby the sponge titanium powder is crushed by collapse and abrasion due to a gravitational drop of the crushing mediums. On the other hand, in the planetary ball mill, individual sponge titanium particles are rapidly collapsed and consolidated by mutual cooperation between the centrifugal force due to high speed revolution and rotation at a high speed and the Coriolis force. In the conventional ball mill, the centrifugal acceleration applied to the charged material is no more than 1 G and the crushing thereof is carried out by an impact force due to gravitational drop thereof. On the other hand, when employing the planetary ball mill, a very strong physical impact the composite centrifugal acceleration of which exceeds 100 G is applied to the sponge titanium, and the collapsing force thereby is large by far as compared with any other type of mill.

A complicated shape incidental to sponge titanium is rolled to be a flat aquamation and, then, the voids remaining in the powder are collapsed. Further in the media agitating mill, particle shape is corrected to be nearly spherical, and particle size becomes more fine by cutting and diffusion of the particles. In this manner, as a result of two consecutive different mechanical functions performed by combining the planetary ball mill and the media agitating mill, a favorable performance is assured in the adjustment of particle size and shape.

One of the most significant features of the present invention consists in the employment of the planetary ball mill for the treatment of sponge titanium powder. The planetary ball mill itself has been widely used in various industrial fields, and because of the remarkable mechanical function thereof, varieties of possibilities beyond the conventional scope of the crusher are further expected at present. For instance, a so-called mechanical alloying is now possible, in which a plurality of metals composing a hydrogen adsorption alloy are charged in a mill pot to produce a new alloy without dissolution. It is said that in such mechanical alloying, the charged grains are subject to the steps of flattening, flaking, cold forging (kneading), formation of lamellar structure, dispersion, and randomization. Likewise in the transformation of sponge titanium powder into the intermediate sponge titanium particles of high quality according to the present invention, a desirable performance sufficiently substitutable for the known combined performance of conventional HDH method and HIP treatment is accomplished.

It is thus understood that a fundamental process has been developed for producing a material for obtaining a compact completely provided with superior properties of titanium such as high specific intensity, high fatique resistance at a considerably low cost just by molding powder and sintering it using an inexpensive powder of low purity without any HIP treatment, heat treatment or surface treatment at all. Though various peripheral techniques must be further developed by all means, the present invention exhibits at least an advantage of providing a valuable basic technique for widely utilizing titanium or titanium alloy of eminent specific intensity.

Other objects, features and advantages of the present invention will become apparent in the course of the present following description with reference to the accompanying drawings.

BRIEF DESCRIPTION OF THE DRAWINGS

In the drawings forming a part of the present application.

DESCRIPTION OF THE PREFERRED EMBODIMENT

Figure 4:
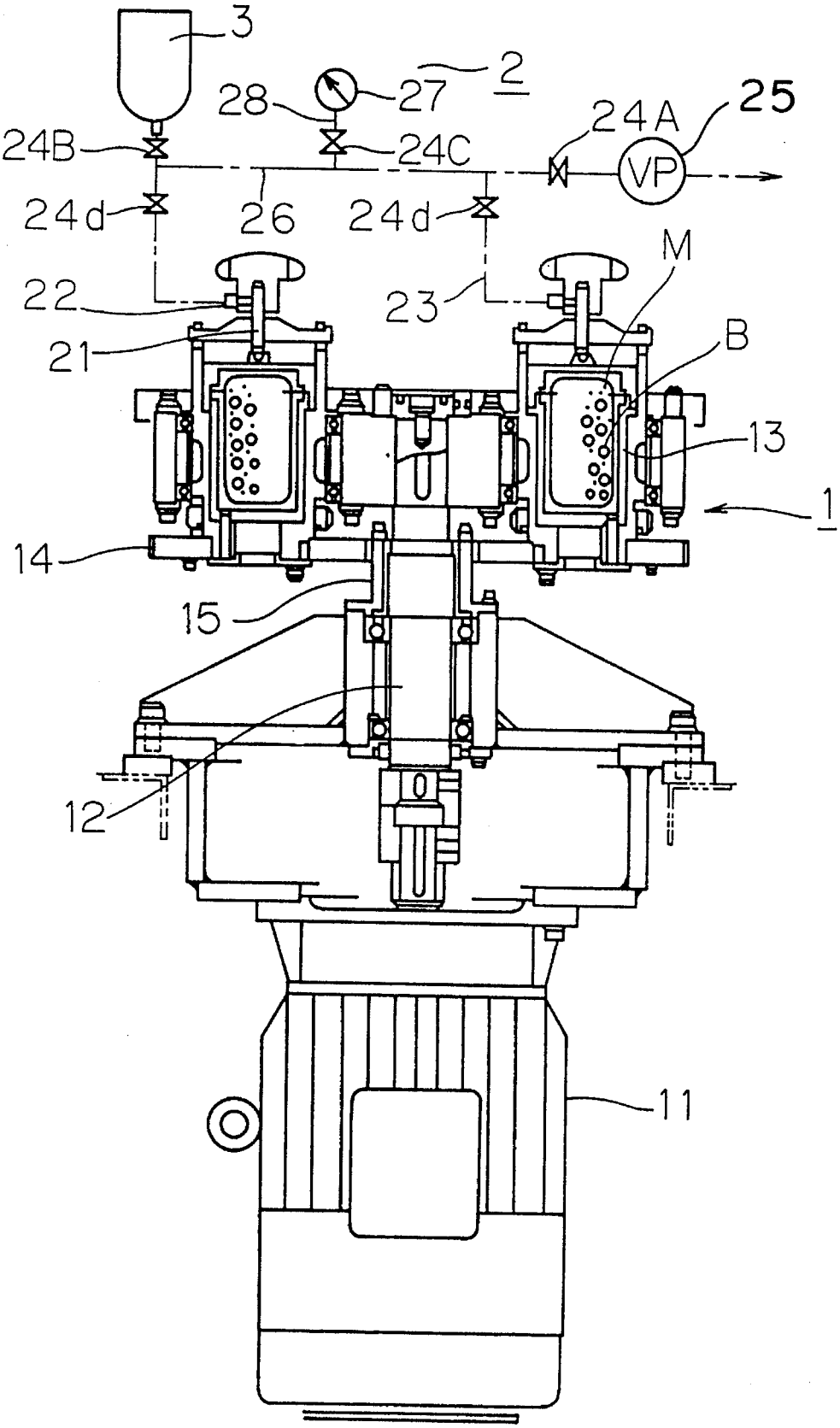
FIG. 4 is a longitudinal sectional view of the planetary ball mill for use in carrying out the present invention.

FIG. 4 shows an example of a planetary ball mill 1 used in the treatment process of sponge titanium powder according to an embodiment of the present invention. In the drawing, a plurality of mill pots 13 revolve due to rotation of a main shaft 12 driven by a motor 2. The mill pots 13 are evenly (i.e., symmetrically in case of two pots, or radially from the main shaft 12 with equal distance in case of three mill pots disposed around the main shaft 12, and these mill pots 13 themselves rotate round their own axis. More specifically, a planetary gear 14 is disposed around each mill pot 13 rotating together with the main shaft 12, and a sun gear 15 mating with the planetary gears 14 is separately rotated or suspended (FIG. 4 shows the suspended state), thereby causing the mill pots 13 to revolve and rotate. The sun gear 15 engages the outside of the main shaft 12. As seen from the drawing, it is a requirement for employing the planetary ball mill 1 in this embodiment that the planetary ball mill has sufficient strength capable of being operated at high speed in which the composite acceleration ratio G exceeds 30 when calculated by the foregoing expression. The crushing balls B, serving as crushing mediums, and the sponge titanium powder M are placed in the mill pots 13, and the internal atmosphere of the mill pots 13 is filled with an inert gas such as Ar gas for preventing oxidation of the treated sponge titanium.

To fill the inside of the mill pots with Ar gas in the atmosphere adjusting means 2, as shown in FIG. 4, a pipe 21 is mounted on a cap of each mill pot 13, and a couple of one-touch couplers are mounted on the top end thereof. The mill pots 13 are connected to a vacuum pump 25 through pipes 23, 26 and a valve 24A, to a pressure gauge 27 through a valve 24C and a pipe 28, and to an Ar gas charging bomb 3 through the pipe 26 and a valve 24B. When completely closing the valve 24B while completely opening the valves 24A, 24C and 24*d*, a vacuum suction is performed by means of the vacuum pump 25 to remove the air from the mill pots 13. After reaching a required degree of vacuum degree, the mill pots 13 are filled with Ar gas from the Ar gas charging bomb 3 by completely closing the valve 24A while opening the valves 24B, 24*d*. Then, after the charged Ar gas pressure has reached a required pressure which is the same as atmospheric pressure or more, the valves 24B and 24*d* are completely closed so as to disconnect the pipe 21 from the pipe 23 at the one-touch coupler section 22. The Ar gas in the mill pots 13 is kept by either of the one-touch couplers 22.

When operating the planetary ball mill, after placing the crushing balls B, charging the sponge titanium powder M in the mill pots 13, and filling the mill pots 13 with Ar gas, a centrifugal force and a corioles force act cooperatively on the crushing balls B and sponge titanium powder M due to revolution and rotation of the planetary ball mill, whereby collapse, consolidation or densification of the titanium particles rapidly take place to break the voids and flatten the particle shape into squamation and, furthermore, bulky chlorides included therein are crushed into fine particles and dispersed to be eventually transformed into intermediate titanium particles.

Figure 5:
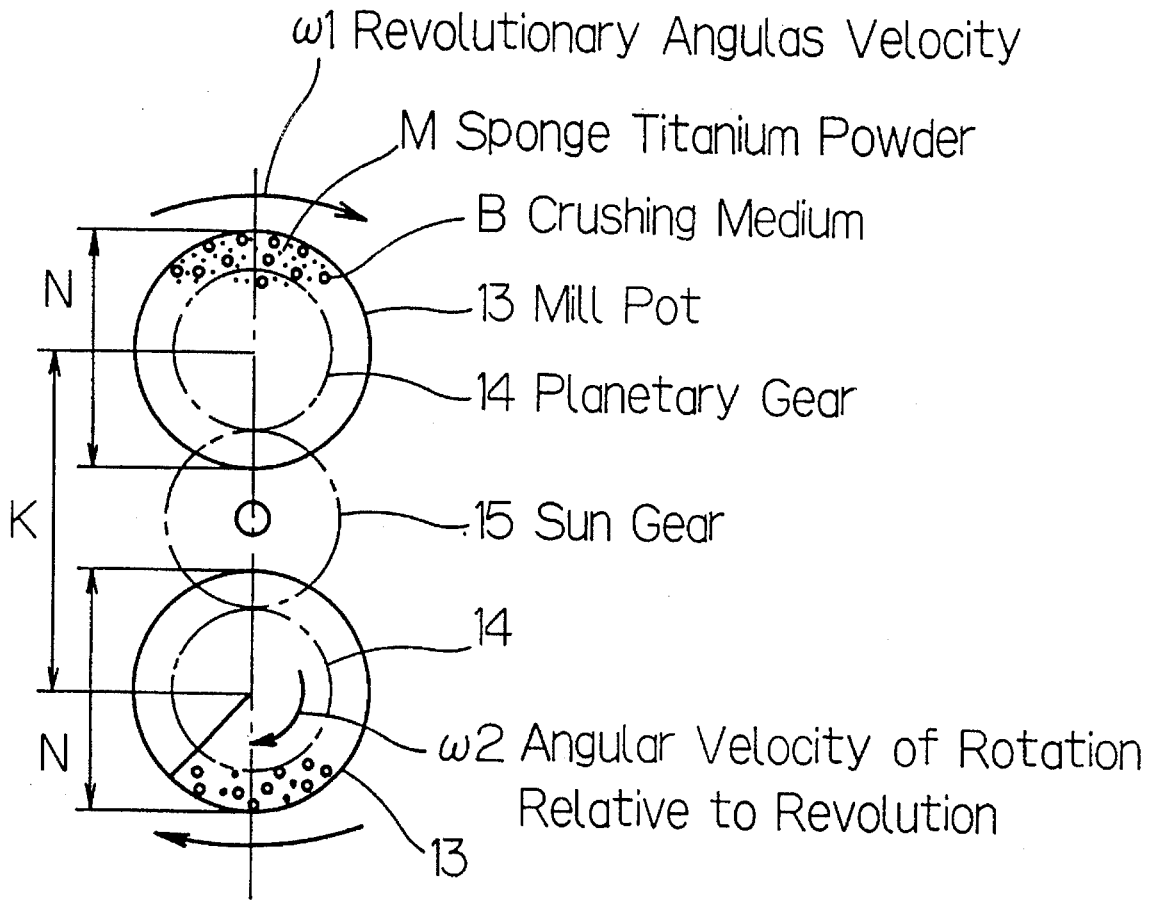
FIG. 5 is a partially longitudinal sectional view showing the operation of the mill pots.

FIG. 5 is a schematic motion diagram of the mill pots of the planetary ball mill, in which $\omega$, indicates a revolutionary angular velocity, $\omega_2$ indicates a rotational angular velocity relative to revolution, a revolutionary diameter K is 0.25 m, and a mill pot internal diameter N is 0.05 m, $R=\omega_2/W_1$. The composite centrifugal acceleration ratio G was calculated using the expression mentioned above so as to be in the range of 30 to 150, and thus the following Table 1 was obtained, where "a max" indicates a composite centrifugal acceleration ($m/s^2$) and there is a relation of G=a max/g.

TABLE 1

| G (–) | $\omega_1$ (1/S) | K (m) | N (m) | $\omega_2$ (1/S) | R (–) | a max ($m/S^2$) |
|---|---|---|---|---|---|---|
| 30 | 40.3 | 0.25 | 0.25 | 20.1 | 0.5 | 294 |
| 150 | 90.1 | 0.25 | 0.05 | 45.0 | 0.5 | 882 |

In the mentioned relations between respective elements, the relation between revolution and rotation is important.

Figure 6A:
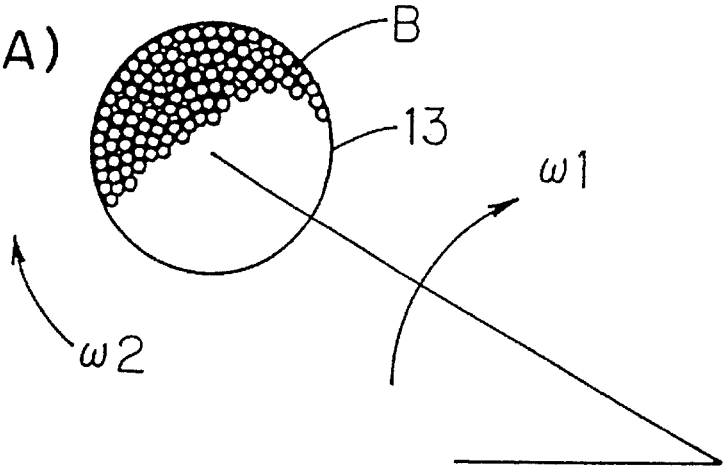
FIGS. 6 (A), (B) and (C) are sectional views respectively showing the change in operating conditions and the change in behavior in the mill pots.
Figure 6B:
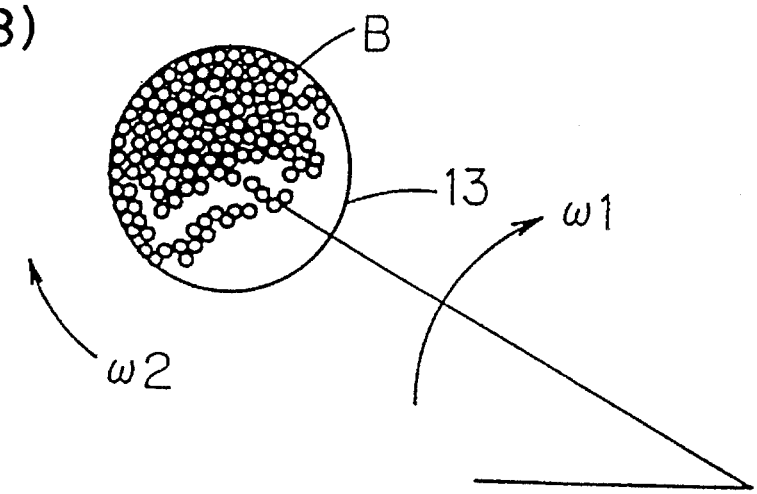
Figure 6C:
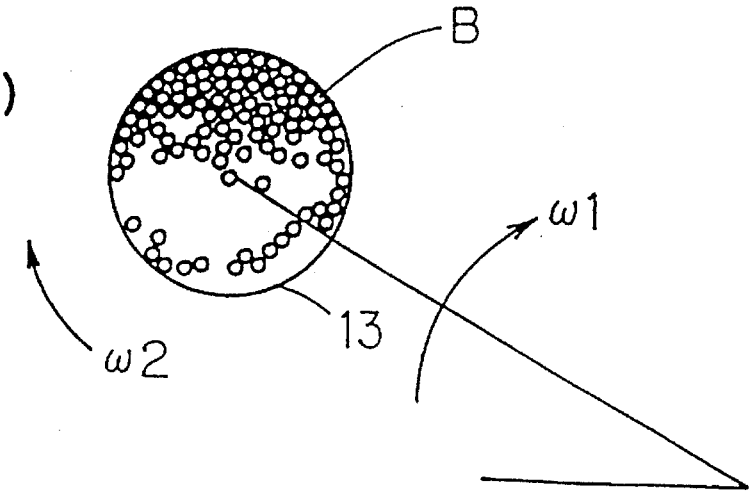

FIGS. 6 (A), (B) and (C) show a relation between motional conditions of the crushing medium (balls) B in a mill pot 13 and the angular velocity of revolution and rotation. Establishing that $\omega_1$ indicates a revolutionary angular velocity, $\omega_2$ indicates a rotational angular velocity relative to revolution and the ratio $R=\omega_2/\mathbf{107}_1$, FIG. 6(A) shows a condition in the mill pot when R is 0.5. In such a condition, the balls B surge in a group along the inner periphery of the mill pot, thereby applying an effective compressive force and shearing force to the charged metallic powder between the inner peripheral surface and the balls or between one ball and another; thus the entire sponge titanium powder is effectively collapsed and densified or consolidated. FIG. 6 (B) shows a behavior of the balls B when R=1.0, and FIG. 6(C) shows another behavior of the balls B when R=1.22. It was acknowledged that when the angular velocity ratio R between revolution and rotation is increased, a part of the balls comes to separate from the inner peripheral surface and leap about in the internal space of the mill pot. Therefore part of the energy is wasted by collision only among the balls, which is an undersirable phenomenon from the viewpoint of efficient collapse and densification of the sponge titanium powder. This undesirable tendency becomes more frequent when the mentioned angular velocity ratio R is larger, and when the ratio R exceeds 1.9, efficient treatment of the sponge titanium powder no longer takes place, no matter that the composite centrifugal acceleration ratio G is more than 30. That is, neither improvement in fluidity of intermediate powder to be obtained after the treatment as described later nor increase in bulk specific density can be achieved. Therefore, the angular velocity ratio R between revolution and rotation was uniformly set to 0.5 in this example, and it was found preferable to set the ratio R in the range of 1.5 to 0.3.

Figure 1:
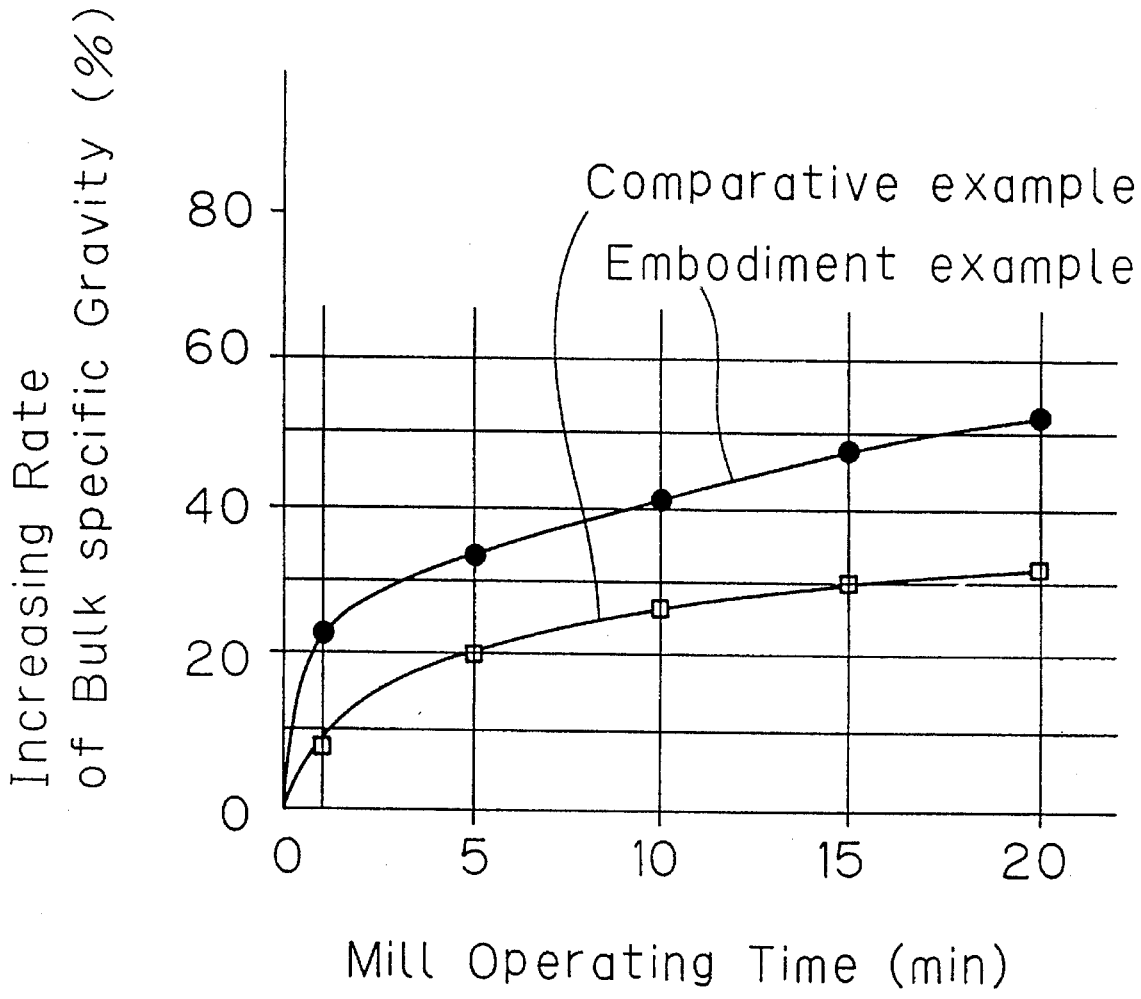
FIG. 1 is a diagram showing a relationship between the operating time of the planetary ball mill and the change in increasing rate of bulk density.
Figure 2:
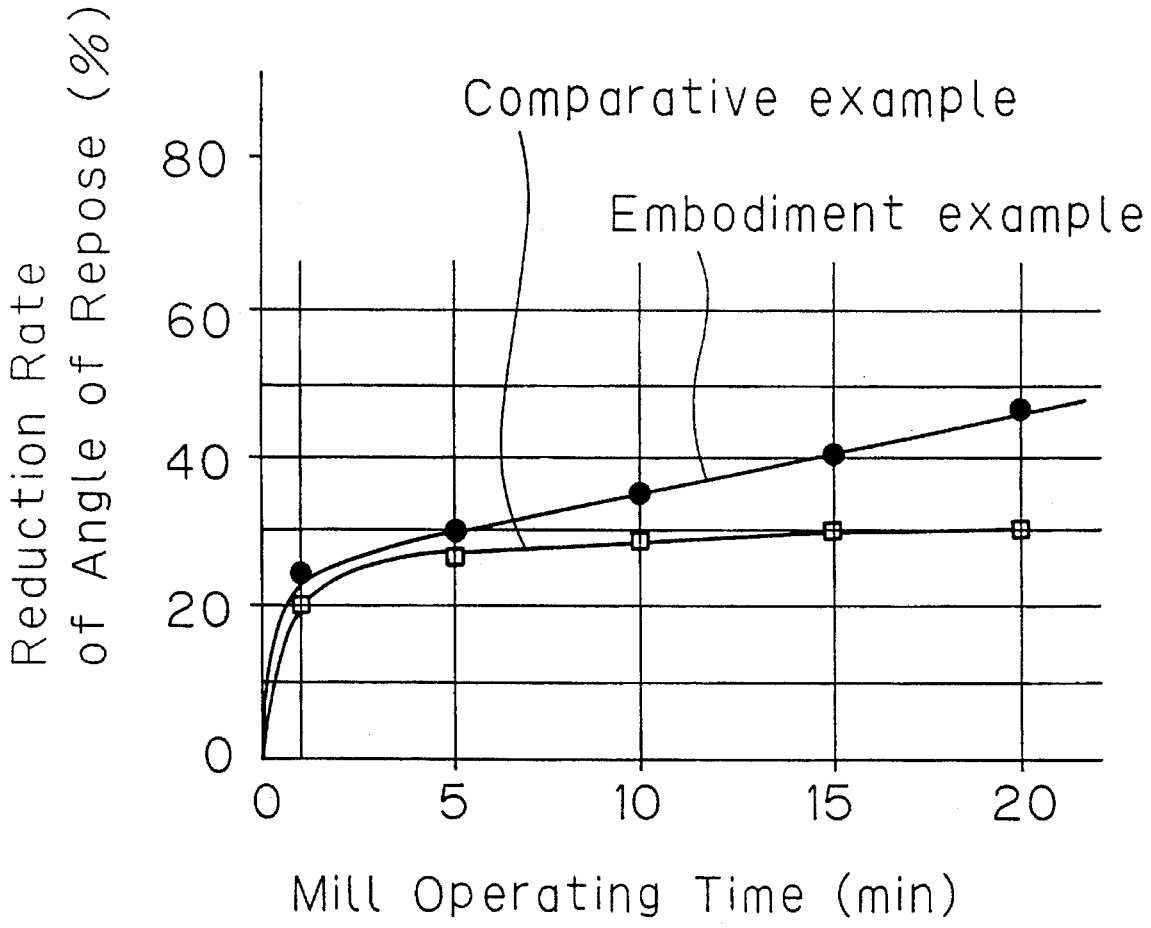
FIG. 2 is a diagram showing a relationship between the operating time of the planetary ball mill and the change in the reduction rate of the angle of repose.

With regard to the characteristics of the intermediate titanium powder obtained by the treatment process of the foregoing embodiment, FIG. 1 is a diagram showing a relation between the operating time of the planetary ball mill and the increasing rate of bulk specific density of a sample in the case where a sponge fine of –250 μm in particle size was charged into the mill pots of the planetary ball mill in FIG. 4 together with ceramic beads, and the planetary ball mill was operated at a high speed under an gas atmosphere so that the composite centrifugal acceleration ratio G=150, and an after-treatment was applied to the sample by means of a stirring mill for five minutes. FIG. 2 is a diagram showing a relation of the same sample between the reduction rate of the angle of repose and the operating time of the planetary ball mill. In both FIGS. 1 and 2, performance of the example is compared with a comparative example which comparative sample was treated only by the known stirring mill method for the same amount of time as the example of the present invention. It is obviously understood from these diagrams that the treatment of the intermediate particles according to the present invention shows a significant improvement in the aspect of fluidity and consolidation of the treated particles and that the intermediate particles obtained by the embodiment of the present invention is a superior starting material for near-net-shape formation by powder metallurgy.

Figure 3:
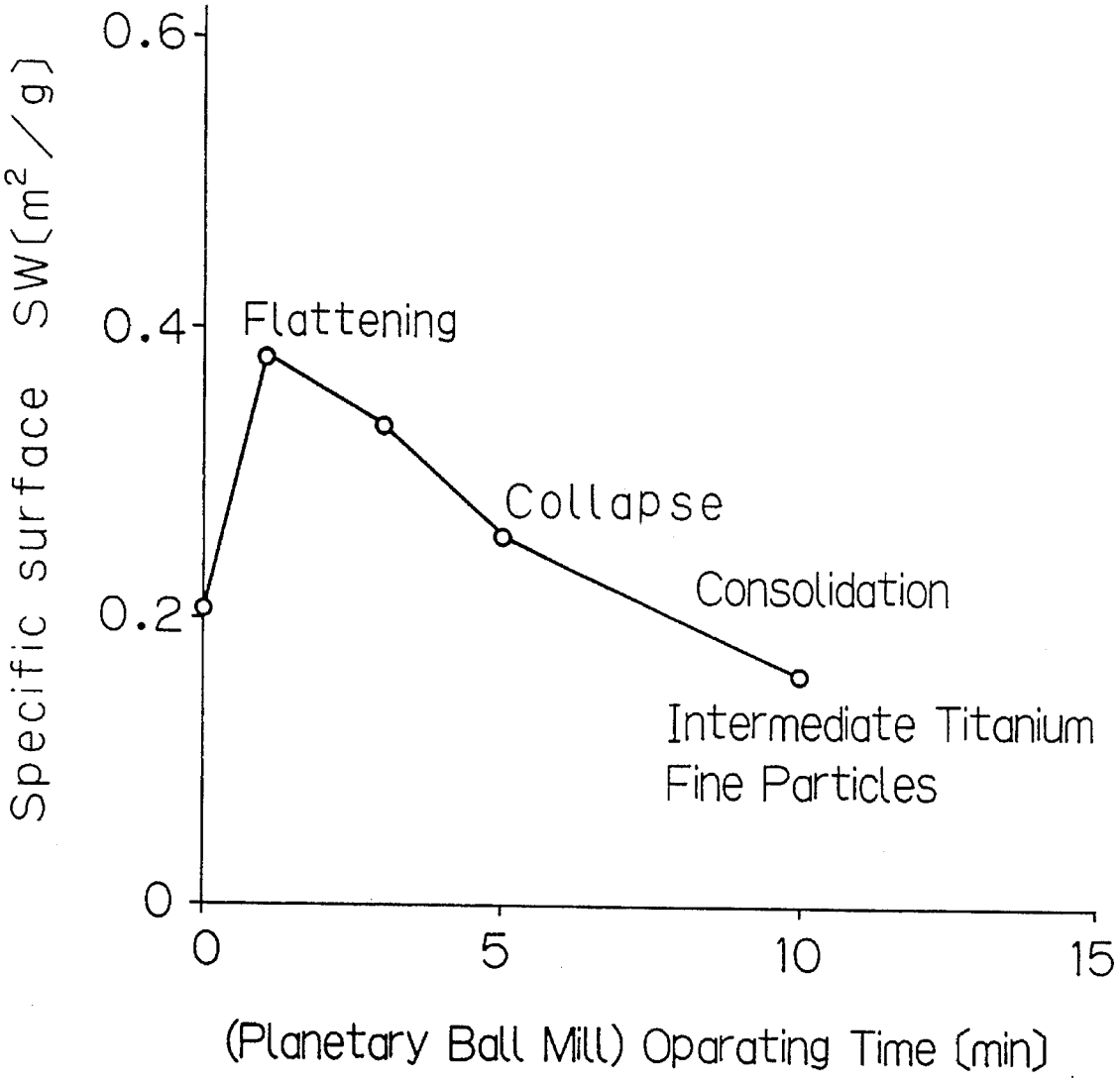
FIG. 3 is a diagram showing a relationship between the operating time of the planetary ball mill and the change in specific surface area.

FIG. 3 is a diagram showing a relation between operating time of the ball mill and specific surface of the same sample during the passage of ten minutes, and in which measurement was performed by the BET method using a krypton gas. As seen from the drawing, the curve in FIG. 3 is quite different from those in FIGS. 1 and 2. That is, the sponge fine is comprised of irregular and porous particles like a sponge at the initial stage of charging it into the mill pots of the planetary ball mill. At the first collapse stage, the voids of the fine particles are hardly collapsed and the entire shape of each particle spreads out to become flat and, therefore, the specific surface area itself is increased. However, when continuing the collapsing step further, the voids remaining in every particle collapse and the particles are reformed into an elaborate squamation. It was acknowledged by the microscopic inspection of the samples extracted at several points during the mentioned ten minute treatment that the apparent specific surface area becomes small through the ten minute treatment in the planetary ball mill as compared with the initial charging step, and the particle shape becomes quite different from that before the collapse.

As many apparently widely different embodiments of the present invention may be made without departing from the spirit and scope thereof, it is to be understood that the present invention is not limited to the specific embodiments thereof except as defined in the appended claims.

What is claimed is:

1. A treatment process of sponge titanium powder, comprising the steps of: charging a sponge titanium powder into mill pots of a planetary ball mill together with crushing mediums; collapsing and consolidating particles of the sponge titanium powder into a squamation under an inert atmosphere in the mill pots; and adjusting particle size and particle diameter by cutting the squamated powder particle under an inert atmosphere in a crushing media agitating mill, thereby reforming the sponge titanium powder into intermediate titanium particles suitable as a starting material for producing titanium or titanium alloy products by powder metallurgy, wherein said planetary ball mill is a batch type planetary ball mill in which a composite crushing acceleration ratio G applied to internal parts of the mill pots and expressed below is not less than 30, and the angular velocity ratio R of rotation and revolution is not more than 1.9:

$$G=a\ max/g=(_{\omega 1})^2/2g\ (k+N\times)1+R)^2)$$

where G: is the composite centrifugal acceleration ratio, a max: is the composite centrifugal acceleration ($m/s^2$), g: is the gravitational acceleration ($m/s^2$), $_{\omega 1}$: is the angular velocity of revolution (1/s), k: is the diameter of revolution (m), N: is the mill pot internal diameter (m), $_{\omega 2}$: is the rotational angular velocity relative to revolution; and R: $_{\omega 2}/_{\omega 1}$.

* * * * *